US007786063B2

(12) United States Patent
Yoshikawa et al.

(10) Patent No.: US 7,786,063 B2
(45) Date of Patent: Aug. 31, 2010

(54) DETERGENT COMPOSITION FOR CIP COMPRISING A C10-C14 ALIPHATIC HYDROCARBON AND NONIONIC SURFACTANT

(75) Inventors: Kiyoaki Yoshikawa, Wakayama (JP); Nobuyuki Suzuki, Wakayama (JP); Junichi Inokoshi, Wakayama (JP); Shigeru Tamura, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/573,658

(22) Filed: Oct. 5, 2009

(65) Prior Publication Data

US 2010/0093589 A1 Apr. 15, 2010

Related U.S. Application Data

(62) Division of application No. 10/564,352, filed as application No. PCT/JP2004/010236 on Jul. 12, 2004, now abandoned.

(30) Foreign Application Priority Data

Jul. 14, 2003 (JP) ..... 2003-273887
Dec. 19, 2003 (JP) ..... 2003-423201

(51) Int. Cl.
*C11D 3/43* (2006.01)
*C11D 3/22* (2006.01)

(52) U.S. Cl. ..... 510/234; 510/213; 510/218; 510/247; 510/251; 510/253; 510/271; 510/432; 510/470

(58) Field of Classification Search ..... 510/213, 510/218, 234, 251, 247, 253, 271, 432, 470
See application file for complete search history.

(56) References Cited

U.S. PATENT DOCUMENTS

| | | | | |
|---|---|---|---|---|
| 3,650,965 | A | 3/1972 | Cantor et al. | |
| 4,911,856 | A | 3/1990 | Lokkesmoe et al. | |
| 4,985,154 | A * | 1/1991 | Balzer et al. | 507/211 |
| 5,002,079 | A | 3/1991 | Cadwell et al. | |
| 5,435,936 | A * | 7/1995 | Broze | 510/406 |
| 5,549,836 | A | 8/1996 | Moses | |
| 5,571,446 | A | 11/1996 | Rouillard | |
| 5,597,507 | A | 1/1997 | Garrett et al. | |
| 5,707,948 | A | 1/1998 | Evers et al. | |
| 5,783,542 | A | 7/1998 | Rouillard | |
| 5,972,874 | A | 10/1999 | Libutti et al. | |
| 5,998,358 | A | 12/1999 | Herdt et al. | |
| 6,117,830 | A * | 9/2000 | Yokosuka et al. | 510/242 |
| 6,407,051 | B1 | 6/2002 | Smith et al. | |
| 6,750,160 | B1 * | 6/2004 | Hanaoka et al. | 442/72 |
| 2003/0013630 | A1 * | 1/2003 | Ishikawa et al. | 510/475 |
| 2003/0037807 | A1 | 2/2003 | Kawakami et al. | |
| 2003/0181347 | A1 * | 9/2003 | Johansson et al. | 510/417 |
| 2003/0191037 | A1 * | 10/2003 | Rindo et al. | 510/185 |
| 2004/0023834 | A1 * | 2/2004 | Inoue et al. | 510/421 |
| 2009/0188533 | A1 * | 7/2009 | Levitt et al. | 134/28 |

FOREIGN PATENT DOCUMENTS

| | | | |
|---|---|---|---|
| CA | 2291882 | A1 | 6/2001 |
| EP | 0412957 | A1 | 2/1991 |
| GB | 2371561 | A | 7/2002 |
| JP | 10-183191 | A | 7/1998 |
| JP | 11-510204 | A | 9/1999 |
| JP | 2001-49296 | A | 2/2001 |
| JP | 2001-207190 | A | 7/2001 |
| JP | 2002-97494 | A | 4/2002 |
| JP | 2002-105489 | A | 4/2002 |
| JP | 2002-540253 | A | 11/2002 |
| JP | 2003-49193 | A | 2/2003 |
| WO | WO-97/05227 | A1 | 2/1997 |
| WO | WO-98/17776 | A2 | 4/1998 |
| WO | WO-00/56853 | A1 | 9/2000 |

* cited by examiner

*Primary Examiner*—Charles I Boyer
(74) *Attorney, Agent, or Firm*—Birch, Stewart, Kolasch & Birch, LLP

(57) ABSTRACT

The invention relates to a detergent composition for CIP, which comprises (A) a solvent having an SP value of 6 to 9 at 25° C. and (B) a surfactant such as a nonionic surfactant.

12 Claims, No Drawings

DETERGENT COMPOSITION FOR CIP COMPRISING A C10-C14 ALIPHATIC HYDROCARBON AND NONIONIC SURFACTANT

CROSS REFERENCE

This application is a Divisional of U.S. application Ser. No. 10/564,352, filed on Jul. 7, 2006, now abandoned which is the national phase of PCT/JP2004/010236, filed on Jul. 12, 2004, which designated the United States and which claims priority to Japanese Application 2003-273887 filed on Jul. 14, 2003 and Japanese Application 2003-423201 filed Dec. 19, 2003. The entire contents of the above applications are hereby incorporated by reference.

FIELD OF THE INVENTION

The present invention relates to a detergent composition for CIP and a CIP cleaning method. The present invention relates in particular to a detergent composition for CIP and a CIP cleaning method which are used in cleaning productive facilities and production apparatuses in food and drink factories etc.

BACKGROUND OF THE INVENTION

In food factories, drink factories etc., cleaning of productive facilities and apparatuses is conducted before changing the type of product or after operation, wherein parts such as pipes and tanks hardly removable for cleaning are subjected to CIP cleaning (stationary cleaning). This CIP is an abbreviation of cleaning in place, which is a method of cleaning facilities without dismantling them.

CIP cleaning is used widely in food factories, drink factories, etc. Particularly in drink factories, it is important that cleaning is conducted sufficiently such that at the time of changing the type of product etc., previously charged materials do not remain and flavors compounded with the previously charged materials are not mixed in materials to be charged.

In food factories etc., therefore, CIP cleaning is carried out for a sufficient time, but flavors are liable to remain in packing (sealing portion) such as tube connections particularly in production lines, so significant labor is required to remove the flavors sufficiently.

As the speed of production is increased and the type of drink is increased in recent years, the frequency of changing the type of product is increased, and a loss in time in the CIP process causes a significant reduction in productivity.

In CIP cleaning, alkali cleaning and/or acid cleaning has been conducted suitably depending on dirt in the inside of pipes in productive facilities and production apparatuses, and there are cases where oxidizing agents such as hypochlorite, isocyanurate, percarbonate and perborate are used to increase the efficiency of cleaning. In spite of use of such oxidizing agents, sufficient deodorizing effects can still not be obtained, and depending on working conditions, apparatuses may be damaged.

Under these circumstances, there are proposed techniques of further improving the efficiency of cleaning and the efficiency of removing flavors in CIP cleaning. For example, techniques of deodorizing and cleaning using nonionic surfactants are disclosed in, for example, JP-A 2003-49193.

JP-A 2001-49296, JP-A 2001-207190 and JP-A 2002-105489 disclose, respectively, use of nonionic surfactants and amphoteric surfactants in detergents in beer brewing facilities.

On one hand, JP-A 2002-97494 discloses techniques of cleaning a chemical plant with aromatic hydrocarbons, and JP-A 10-183191 discloses techniques of cleaning with a solvent for industrial apparatuses, which employs an organic solvent.

SUMMARY OF THE INVENTION

The present invention relates to a detergent composition for CIP, which comprises (A) a solvent having an SP value of 6 to 9 at 25° C. [referred to hereinafter as component (A)] and (B) a surfactant [referred to hereinafter as component (B)].

The present invention also relates to a CIP cleaning method which comprises contacting a cleaning medium (I) containing (A) a solvent having an SP value of 6 to 9 at 25° C. and (B) a surfactant, with a material to be cleaned.

The present invention further relates to a CIP cleaning method which comprises a step (1) of contacting a cleaning medium (I) containing (A) a solvent having an SP value of 6 to 9 at 25° C. and (B) a surfactant, with a material to be cleaned, and thereafter, a step (2) of contacting a cleaning medium (II) containing (A) a solvent having an SP value of 6 to 9 at 25° C., at a concentration of less than 0.5 wt %, and (B) a surfactant, with the material to be cleaned.

Furthermore, the present invention relates to use of the composition in CIP cleaning or a method of cleaning an object of CIP with the composition.

DETAILED DESCRIPTION OF THE INVENTION

The removal of flavors in the prior art is not satisfactory.

The techniques in JP-A 2002-97494 and JP-A 10-183191 supra are not suitable for food factories because of problems such as residual base materials and residual flavors.

In view of these circumstances, the invention provides a detergent composition for CIP and a CIP cleaning method, which can remove residual flavors efficiently in the present CIP process and the smell of solvent hardly remains after cleaning.

According to the present invention, flavors can be efficiently removed, the smell of solvent hardly remains after cleaning, and the cleaning time can be made shorter than conventional. In particular, the present invention is suitable for cleaning plants in food industry.

<Component (A)>

The component (A) in the present invention is a solvent having an SP value of 6 to 9 at 25° C., and includes hydrocarbon compounds represented by mineral oil, esters synthesized from alcohols and fatty acids/ester compounds represented by edible oils, and alcohol compounds represented by higher alcohols. From the viewpoint of deodorization, the component (A) is preferably a hydrocarbon compound or an ester compound, particularly preferably a hydrocarbon compound. The hydrocarbon compounds, ester compounds and alcohol compounds can be used alone or as a mixture of two or more thereof.

The hydrocarbon compound is preferably a C5 to C24 hydrocarbon compound. The hydrocarbon compound includes aliphatic hydrocarbons and aromatic hydrocarbons, and from the viewpoint of base smell and deodorization, the hydrocarbon compound is preferably an aliphatic hydrocarbon, more preferably a C5 to C20 aliphatic hydrocarbon, still more preferably a C8 to C14 aliphatic hydrocarbon, further more preferably a C10 to C14 aliphatic hydrocarbon. Specific examples include pentane, isopentane, hexane, isohexane, cyclohexane, heptane, isoheptane, octane, isooctane, nonane, isononane, decane, isodecane, undecane, isoundecane, dodecane, isododecane, tridecane, isotridecane, tetradecane, isotetradecane, pentadecane, isopentadecane, hexadecane, isohexadecane, heptadecane, isoheptadecane, octadecane, isooctadecane, nonadecane, isononadecane, C10 α-olefin, C12 α-olefin, and C14 α-olefin, preferably decane, isodecane, undecane, isoundecane, dodecane, isododecane, tridecane, isotridecane, tetradecane, isotetradecane, and C12 α-olefin. The aromatic hydrocarbon includes alkyl (preferably C1 to C18) substituted benzene such as dodecyl benzene.

The ester compound is preferably at least one kind of ester compound represented by the following formulae (1) to (4):

(1)

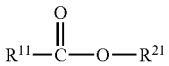

(2)

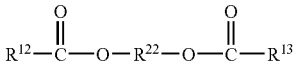

(3)

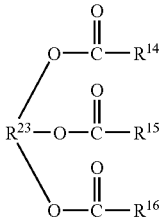

(4)

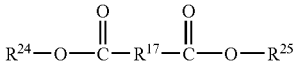

wherein $R^{11}$ to $R^{16}$ may be the same or different, and each represent a C1 to C30 alkyl group, a C1 to C30 alkyl group substituted with a hydroxyl group, a C2 to C30 alkenyl group, a C6 to C30 aryl group, a C7 to C30 arylalkyl group or a C7 to C30 alkylaryl group; $R^{17}$ represents a C1 to C20 alkylene group or a C2 to C20 alkenylene group; $R^{21}$, $R^{24}$ and $R^{25}$ may be the same or different, and each represent a C1 to C24 alkyl group, a C2 to C24 alkyl group substituted with a hydroxyl group, a C2 to C24 alkenyl group, a C6 to C24 aryl group, a C7 to C24 arylalkyl group or a C7 to C24 alkylaryl group; $R^{22}$ represents a C2 to C24 alkylene group, a C2 to C24 alkenylene group, a C6 to C24 arylene group, a C7 to C24 arylene alkylene group or a C7 to C24 alkylarylene group; and $R^{23}$ represents a group comprising a C3 to C24 trivalent alcohol from which a hydroxyl group was removed.

Specifically, the ester compound of the general formula (1) includes methyl hexanoate, hexyl acetate, ethyl butyrate, octyl acetate, isoamyl acetate, ethyl myristate, octyl stearate, isooctyl myristate, oleyl oleate, isooctyl oleate, methyl laurate, ethyl laurate, methyl stearate, ethyl stearate, isoamyl butyrate, phenylethyl acetate, geranyl formate, citronellyl acetate, ethyl benzoate, octyldodecyl oleate, octyldodecyl stearate and octyldodecyl myristate, among which ethyl myristate, octyl stearate, isooctyl myristate, oleyl oleate, isooctyl oleate, methyl laurate, ethyl laurate, methyl stearate, ethyl stearate, octyldodecyl oleate, octyldodecyl stearate and octyldodecyl myristate are preferable.

The ester compound of the general formula (2) includes ethyleneglycol dioleate, ethyleneglycol dilaurate, ethyleneglycol distearate, propyleneglycol dilaurate and propyleneglycol distearate, among which ethyleneglycol dioleate, ethyleneglycol dilaurate and propyleneglycol dilaurate are preferable.

The ester compound of the general formula (3) includes triglycerides present in various vegetable oils represented by rapeseed oil, olive oil, coconut oil, sesame oil, corn oil and soybean oil, triglycerides, glycerin tristearate or glycerin trilaurate present in various animal oils represented by tallow, lard, bone oil, whale oil, herring oil and sardine oil, among which triglycerides or glycerin trilaurate present in rapeseed oil, coconut oil and soybean oil are preferable.

The ester compound of the general formula (4) includes dimethyl adipate, diethyl adipate, dioctyl phthalate, dimethyl azelate and diethyl azelate, among which dimethyl adipate, diethyl adipate and dioctyl phthalate are preferable.

The alcohol compound is a compound represented by the following general formula:

R—OH wherein R represents a C7 to C24 alkyl group, a C7 to C24 alkenyl group, a C8 to C24 aryl group, a C8 to C24 alkylaryl group or a C8 to C24 arylalkyl group. The alcohol is preferably the one having a solubility of 10 wt % or less in water at 25° C.

Specific examples of the alcohol include iso-heptanol, iso-octanol, n-nonanol, n-decanol, iso-decanol, n-dodecanol, iso-tridecanol, n-tetradecanol, iso-tetradecanol, n-hexadecanol, iso-hexadecanol, n-octadecanol, iso-octadecanol, octyldodecyl alcohol, n-docosanol, oleyl alcohol, phytol, iso-phytol, and ethyl benzyl alcohol. The alcohol is preferably iso-heptanol, iso-octanol, n-nonanol, n-decanol, iso-decanol, n-dodecanol, iso-tridecanol, n-tetradecanol, iso-tetradecanol, iso-hexadecanol, iso-octadecanol, octyldodecyl alcohol, oleyl alcohol, iso-phytol, benzyl alcohol or ethyl benzyl alcohol, more preferably iso-octanol, n-nonanol, n-decanol, iso-decanol, n-dodecanol, iso-tridecanol, iso-tetradecanol, iso-hexadecanol, iso-octadecanol, octyldodecyl alcohol or oleyl alcohol. The affix "n-" means that the alcohol is a linear chain, and the affix "iso-" means that the alcohol has a branched chain (this hereinafter applies).

The component (A) in the present invention has an SP value of 6 to 9 at 25° C. The SP value is a solubility parameter δ [$(cal/cc)^{1/2}$] used generally as a measure of compatibility among substances, and for excellent deodorization (ability to remove smell), the SP value at 25° C. of the component (A) in the present invention is 6 to 9, preferably 7 to 8.5, more preferably 7 to 8. From the viewpoint of deodorization, the melting point of the component (A) in the present invention is preferably 100° C. or less, more preferably 80° C. or less, still more 65° C. or less.

<Component (B)>

The component (B) includes a nonionic surfactant, anionic surfactant, amphoteric surfactant and cationic surfactant, and from the viewpoint of facilitating the emulsifying dispersibility of the component (A), the component (B) is preferably a nonionic surfactant and anionic surfactant.

The nonionic surfactant includes polyoxyalkylene alkyl ether, polyoxyalkylene alkylamine, polyoxyalkylene fatty acid ester, alkyl polyglycoside, alkyl glyceryl ether, glycerin fatty acid ester, polyglycerin fatty acid ester, sucrose fatty acid ester, polyoxyethylene/polyoxypropylene block polymer, and polyoxyalkylene polyvalent alcohol fatty acid ester, among which polyoxyalkylene fatty acid ester, alkyl polyglycoside, alkyl glyceryl ether, polyoxyalkylene alkyl ether, polyoxyalkylene alkyl amine, and polyoxyalkylene polyvalent alcohol fatty acid ester (polyoxyalkylene sorbitan fatty acid ester, polyethylene glycol fatty acid ester etc.) are preferable. In these nonionic surfactants, polyoxyalkylene is preferably polyoxyethylene, polyoxypropylene and a mixture thereof, wherein each of the alkyl groups is preferably a C8 to C18 group, and some alkyl groups may be changed into alkenyl groups. The number of carbon atoms in the fatty acid is preferably 8 to 18.

The nonionic surfactant, particularly polyoxyalkylene alkyl ether, is preferably the one having an HLB value of not less than 3 to less than 8 as determined by the Griffin's formula.

The anionic surfactant includes a fatty acid salt (preferably C8 to C24), an alkyl (preferably C8 to C24) sulfonate, an alkyl (preferably C8 to C18) benzene sulfonate, an alkyl (preferably C8 to C24) sulfate, an alkyl (preferably C2 to C24) phosphate, a polyoxyalkylene (preferably polyoxyethylene) alkyl (preferably C8 to C18) sulfate, a polyoxyalkylene (preferably polyoxyethylene) alkyl (preferably C2 to C24) phosphate, a polyoxyalkylene (preferably polyoxyethylene) alkyl (preferably C8 to C18) carboxylate, and an alkyl (preferably C6 to C18) sulfosuccinate.

The amphoteric surfactant includes an alkyl (preferably C8 to C18) amine oxide, an alkyl (preferably C8 to C18) dimethylaminoacetic acid betaine, an alkyl (preferably C8 to C18) amidopropyl betaine, an alkyl (preferably C8 to C18) hydroxysulfobetaine, and an alkyl (preferably C8 to C18) carboxymethyl hydroxyethyl imidazolium betaine.

The cationic surfactant includes a trimethylammonium alkyl (preferably C6 to C24) chloride, a dimethylammonium dialkyl (preferably C6 to C18) chloride, and benzalkonium (preferably C6 to C18) chloride.

<Detergent Composition for CIP>

In the detergent composition for CIP according to the present invention, the weight ratio of the component (A) to the component (B), that is, (A)/(B), is preferably 1/99 to 99/1, more preferably 20/80 to 90/10, still more preferably 30/70 to 70/30. When the weight ratio of (A)/(B) is 99/1 or less, the stability of the dispersion system is improved and absorptive contamination of pipes etc. is eliminated. When the weight ratio of (A)/(B) is 1/99 or more, a sufficient deodorizing effect can be obtained.

From the stability and deodorizing effect of the detergent composition for CIP according to the present invention, the composition contains the component (A) in an amount of preferably 1 to 99 wt %, more preferably 3 to 70 wt %, still more preferably 5 to 50 wt %. The detergent composition contains the component (B) in an amount of preferably 1 to 99 wt %, more preferably 5 to 80 wt %, still more preferably 10 to 70 wt %. The detergent composition for CIP according to the present invention may or may not contain water, but from the viewpoint of handling, the composition contains water in an amount of preferably 1 to 99 wt %, more preferably 10 to 90 wt %, still more preferably 20 to 70 wt %, further more preferably 30 to 65 wt %.

Preferable for the cleaning effect in the present invention is a combination wherein the component (A) is a C10 to C14 aliphatic hydrocarbon, at least one kind of ester compound represented by the general formula (1) to (4) above, or a C7 to C24 monovalent alcohol, and the component (B) is a surfactant selected from an alkyl polyglycoside (specifically decyl glucoside, undecyl glucoside, lauryl glucoside, tetradecyl glucoside or the like), an alkyl glyceryl ether (specifically 2-ethyl-hexyl glyceryl ether, octyl glyceryl ether, isodecyl glyceryl ether, decyl glyceryl ether, dodecyl glyceryl ether or the like), a polyoxyalkylene fatty acid ester (specifically polyoxyethylene oleate, polyoxyethylene laurate or the like), a polyoxyalkylene alkyl ether having an HLB of not less than 3 to less than 8, and a polyoxyalkylene alkyl amine (specifically, polyoxyethylene lauryl amine, polyoxyethylene stearyl amine or the like).

In addition to the components (A) and (B), a defoaming agent, a rust preventive, a chelating agent, and a water-soluble solvent other than the component (A), if necessary, may be added to, and used in, the detergent composition for CIP according to the present invention.

The detergent composition for CIP according to the present invention is diluted with a non-aqueous solvent, an aqueous solvent, water or the like, prior to use as a cleaning solution in CIP cleaning. From economical and safety points of view, the diluent medium is preferably water. From the viewpoint of detergency and an economical viewpoint, the concentration of the component (A) in the diluted cleaning solution is preferably 0.01 to 20 wt %, more preferably 0.1 to 10 wt %, still more preferably 0.5 to 5 wt %. From the viewpoint of the emulsifying dispersibility of the component (A), the concentration of the component (B) in the diluted cleaning solution is preferably 0.01 to 20 wt %, more preferably 0.1 to 15 wt %, still more preferably 0.5 to 10 wt %.

<CIP Cleaning Method>

As described above, the detergent composition for CIP according to the present invention is used preferably as a diluted cleaning solution in CIP cleaning. Preferably, the cleaning solution is used in cleaning by circulating it in the range of 10 to 98° C. so as to contact with an inner wall of a pipe and various instruments to be cleaned in CIP cleaning. The temperature of the cleaning solution is particularly preferably 40 to 98° C., more preferably 60 to 98° C. The flow rate of the cleaning solution flowing through a pipe is preferably 0.5 to 5 m/sec., more preferably 1 to 3 m/sec.

In the present invention, it is possible to carry out a CIP cleaning method which comprises a step of contacting a cleaning medium (I) containing the components (A) and (B), with a material to be cleaned, and it is further possible to carry out a CIP cleaning method which comprises a step (1) of contacting a cleaning medium (I) containing the components (A) and (B), with a material to be cleaned, and thereafter, a step (2) of contacting a cleaning medium (II) containing the component (B), with the material to be cleaned. The components (A) and (B) used are those described above. After a series of CIP cleaning including cleaning with the cleaning medium (I) or with the cleaning mediums (I) and (II) are finished, sensory evaluation of the rinse is carried out, and when the residual smell is strong, CIP cleaning is repeatedly carried out, or hot-water cleaning is continued, until the level of the smell is sufficiently reduced.

In this case, the medium (I) is preferably a dilution obtained by diluting the detergent composition of the present invention. In the medium (I), the concentration of the component (A) is preferably 0.01 to 20 wt %, more preferably 0.1 to 10 wt %, still more preferably 0.5 to 5 wt %, and the concentration of the component (B) is preferably 0.01 to 20 wt %, more preferably 0.1 to 15 wt %, still more preferably 0.5 to 10 wt %, and from economical and deodorizing viewpoints, the total of the components (A) and (B) is preferably 0.01 to 50 wt %, more preferably 0.1 to 30 wt %, still more preferably 0.2 to 10 wt %.

The component (B) used in the medium (II) may be the same as or different from that used in the medium (I). In the medium (II), the concentration of the component (B) is preferably 0.01 to 30 wt %, more preferably 0.1 to 20 wt %, still more preferably 0.2 to 10 wt %. The medium (II) may contain the component (A), and from the viewpoint of deodorization, the concentration of the component (A) in the medium (II) is preferably less than 0.5 wt %, more preferably 0.3 wt % or less, still more preferably 0.2 wt % or less, further more preferably less than 0.1 wt %.

The component (B) used in the step (1) or the component (B) used in at least one of the steps (1) and (2), preferably the component (B) of both of the steps (1) and (2), is preferably at least one member selected from nonionic surfactants. The nonionic surfactants used are preferably those described above.

CIP cleaning, for example, in a drink plant is conducted in the order of (a) hot-water cleaning→(b) alkali cleaning→(c) hot-water cleaning→(d) acid cleaning→(e) hot-water cleaning, and the final hot-water cleaning (e) may be followed if necessary by cleaning with hypochlorite and hot-water cleaning. The step (1) described above may be carried out in any of such steps, and specifically, the step (1) can be carried out before and/or after any one of the steps (a) to (d) mentioned above, or can be carried out in place of any one of the steps, or can be carried out simultaneously with any one of the steps. The step (1) can be carried out alone or simultaneously with any one of the steps (a) to (e), and in consideration of the total CIP time, the step 1 is carried out preferably simultaneously with any one of the steps (a) to (e). From the viewpoint of deodorization, the step 1 is carried out preferably simultaneously with the alkali cleaning (b) or acid cleaning (d). For further improving deodorization, further use of the step (2) is preferable, and the step (2) may be carried out after the step (1); for example, the step (2) may be conducted just after the step (1) or after another step following the step (1). The steps (1) and (2) may be carried out plural times respectively.

EXAMPLES

Example 1

Using the formulations shown in Table 1, detergent compositions for CIP were prepared. These compositions were used to test deodorization and base smell by the methods described below. The results are shown in Table 1.

(1) Test Sample

An EPDM (ethylene/propylene/diene rubber) sheet (Osaka Sanitary Metal Industries Cooperative Union) that was the same material as in packing was cut in a size of 5 cm×0.5 cm (thickness 2 mm) to give a test piece. The test piece was dipped in a peach flavor (Hasegawa Koryo) at 70° C. for 2 hours to give a test sample.

(2) Test Method

Each detergent composition (2 g in terms of the active ingredients) in Table 1 was introduced into a 100-cc glass bottle with a cap, followed by adding water to adjust the total weight to 100 g. The solution in the glass bottle with a cap was stirred at 80° C. with a magnetic stirrer. Each test sample given an odor by the method described above was introduced into each glass bottle with a cap and subjected to the following cleaning steps (a) to (e). The cleaning steps (a) to (e) were carried out by introducing a cleaning solution or hot water into the 100-cc glass bottle with a cap to clean the test sample successively. In each step, the content in the glass bottle with a cap was stirred at 80° C. with a magnetic stirrer. After a series of the cleaning steps, the test piece was dried and transferred into a 50-cc glass bottle with a cap and stored at room temperature for 12 hours to give a sample for evaluation. In this method, the cleaning with each detergent composition in Table 1 was carried out in the cleaning step (a) mentioned below.

(Cleaning Steps)

(a) Cleaning with detergent: dipping and stirring at 80° C. for 20 minutes.

(b) Alkali cleaning: dipping and stirring at 80° C. for 20 minutes in 2% NaOH aqueous solution.

(c) Hot-water cleaning 1: dipping and stirring at 80° C. for 20 minutes.

(d) Acid cleaning: dipping and stirring for 20 minutes in 0.6% $HNO_3$ aqueous solution.

(e) Hot-water cleaning 2: dipping and stirring at 80° C. for 20 minutes.

(3) Evaluation Method

The flavor smell and base smell of each test piece were evaluated under the following 5 criteria by a panel of 2 examiners. A smaller evaluation point is indicative of a higher deodorizing effect. The average of evaluation points by the 2 examiners was indicated as "degree of residual smell". The evaluation criteria were as follows.

(Evaluation Point and Judgment Criteria)

5: Strong smell is felt.

4: Considerable smell is felt.

3: Slight smell is felt.

2: Faint smell is felt.

1: No smell is felt.

TABLE 1

| | | | Invention product | | | | | | | | | |
|---|---|---|---|---|---|---|---|---|---|---|---|---|
| | | | 1-1 | 1-2 | 1-3 | 1-4 | 1-5 | 1-6 | 1-7 | 1-8 | 1-9 | 1-10 |
| Composition (g) | Component (A) | Normal decane*1 | 0.87 | | | | | | | | | 0.87 |
| | | Normal undecane*2 | | 0.87 | | | | 0.87 | 0.87 | 0.44 | 0.87 | |
| | | Normal dodecane*3 | | | 0.87 | | | | | 0.43 | | |
| | | Normal tridecane*4 | | | | 0.87 | | | | | | |
| | | Normal tetradecane*5 | | | | | 0.87 | | | | | |
| | Component (B) | Nonionic surfactant A*6 | | | | | | | | | 1.13 | |
| | | Nonionic surfactant B*7 | 0.87 | 0.87 | 0.87 | 0.87 | 0.87 | 1.13 | | 0.87 | | |
| | | Nonionic surfactant C*8 | 0.26 | 0.26 | 0.26 | 0.26 | 0.26 | | 1.13 | 0.26 | | |
| | | Anionic surfactant A*9 | | | | | | | | | | 1.13 |
| | | Cationic surfactant A*10 | | | | | | | | | | |
| | | Amphoteric surfactant A*11 | | | | | | | | | | |

TABLE 1-continued

| | | | | | | | | | | | |
|---|---|---|---|---|---|---|---|---|---|---|---|
| Deodorization | | | 2 | 2 | 3 | 3 | 3 | 3 | 3 | 2 | 3 | 3 |
| Base smell | | | 2 | 2 | 1 | 1 | 1 | 2 | 2 | 1 | 2 | 3 |
| | | | | | | Invention product | | Comparative product | | | | |
| | | | | | | 1-11 | 1-12 | 1-1 | 1-2 | 1-3 | 1-4 | 1-5 |
| | Composition (g) | Component (A) | Normal decane*1 | | | | | | | | | |
| | | | Normal undecane*2 | | | 0.87 | | | | | | 2 |
| | | | Normal dodecane*3 | | | | 0.87 | | | | | |
| | | | Normal tridecane*4 | | | | | | | | | |
| | | | Normal tetradecane*5 | | | | | | | | | |
| | | Component (B) | Nonionic surfactant A*6 | | | | | 2 | | | | |
| | | | Nonionic surfactant B*7 | | | | | | 2 | | 1.54 | |
| | | | Nonionic surfactant C*8 | | | | | | | 2 | 0.46 | |
| | | | Anionic surfactant A*9 | | | | | | | | | |
| | | | Cationic surfactant A*10 | | | 1.13 | | | | | | |
| | | | Amphoteric surfactant A*11 | | | | 1.13 | | | | | |
| | Deodorization | | | | | 3 | 2.5 | 4 | 5 | 5 | 5 | 4 |
| | Base smell | | | | | 3 | 3 | 3 | 2 | 2 | 2 | 4 |

*1Reagent (purity 99%) with an SP value of 7.6 at 25° C. and a melting point of 20° C. or less.
*2Reagent (purity 99%) with an SP value of 7.7 at 25° C. and a melting point of 20° C. or less.
*3Reagent (purity 99%) with an SP value of 7.7 at 25° C. and a melting point of 20° C. or less.
*4Reagent (purity 99%) with an SP value of 7.7 at 25° C. and a melting point of 20° C. or less.
*5Reagent (purity 99%) with an SP value of 7.8 at 25° C. and a melting point of 20° C. or less.
*6Nonionic surfactant A: Polyethyleneglycol fatty acid ester [Emanon 4110, manufactured by Kao Corporation].
*7Nonionic surfactant B: Alkyl polyglucoside [Mydol 12, manufactured by Kao Corporation].
*8Nonionic surfactant C: Alkyl glyceryl ether [2-ethyl hexyl glyceryl ether, manufactured by Kao Corporation].
*9Anionic surfactant A: Sodium dialkylsulfosuccinate [Pelex OT-P, manufactured by Kao Corporation].
*10Cationic surfactant A: Lauryltrimethyl ammonium chloride [Quartamin 24P, manufactured by Kao Corporation].
*11Amphoteric surfactant A: Lauryl betaine [Amphitol 24B, manufactured by Kao Corporation].

Example 2

Using the formulations shown in Table 2, Compositions 1 for the cleaning step (1) were prepared. Each of the compositions was used in any one of the following cleaning steps (a) to (d) to test deodorization and base smell by the methods described below. In this test, the solution in a glass bottle with a cap was stirred at 80° C. with a magnetic stirrer. The results are shown in Table 2. The components in Table 2 are the same as in Example 1.

(Cleaning Steps)

(a) Hot-water cleaning 1: dipping and stirring at 80° C. for 20 minutes.

(b) Alkali cleaning: dipping and stirring at 80° C. for 20 minutes in 2% NaOH aqueous solution.

(c) Hot-water cleaning 2: dipping and stirring at 80° C. for 20 minutes.

(d) Acid cleaning: dipping and stirring for 20 minutes in 0.6% $HNO_3$ aqueous solution.

(e) Hot-water cleaning 3: dipping and stirring at 80° C. for 20 minutes.

(1) Test Sample

A sample prepared in the same manner as in Example 1 was used as the test sample.

(2) Test Method

Composition 1 (3.8 g in terms of the active ingredients) in Table 2 was introduced into a 100-cc glass bottle with a cap, followed by adding water to the composition when used in step (a) or a predetermined amount of NaOH and water to the composition when used in step (b), to adjust the total weight to 100 g. The solution in the glass bottle with a cap was stirred at 80° C. with a magnetic stirrer.

When Composition 1 was used in step (a), one test sample was introduced into the glass bottle with a cap containing the prepared dilution containing Composition 1 and subjected to the subsequent steps. Alternatively, when Composition 1 was used in step (b), one test sample after the hot-water cleaning step (a) was introduced into the glass bottle with a cap containing the prepared dilution containing Composition 1 and NaOH and subjected to the subsequent steps. When Composition 1 was used in step (c), one test sample after the hot-water washing step (a) and the alkali cleaning step (b) was introduced into the glass bottle with a cap containing the prepared dilution containing Composition 1, and then subjected to the subsequent steps. When Composition 1 was used in step (d), one test sample after the hot-water washing step (a), the alkali cleaning step (b), and the hot-water cleaning step (c) was introduced into the glass bottle with a cap containing the prepared dilution containing Composition 1 and $HNO_3$, and then subjected to the subsequent step.

After a series of the cleaning steps, each test piece was dried and transferred into a 50-cc glass bottle with a cap, stored at room temperature for 12 hours and used as an evaluation sample.

(3) Evaluation Method

The same evaluation method and criteria as in Example 1 were used.

TABLE 2

| | | | | Invention product | | | | | | | | | Comparative product | | |
|---|---|---|---|---|---|---|---|---|---|---|---|---|---|---|---|
| | | | | 2-1 | 2-2 | 2-3 | 2-4 | 2-5 | 2-6 | 2-7 | 2-8 | 2-9 | 2-1 | 2-2 | 2-3 |
| Composition (g) | Composition 1 | Component (A) | Normal decane | | | 1.65 | | | | | | | | | |
| | | | Normal undecane | 1.65 | 1.65 | | | | | 1.65 | | 1.65 | | | 3.8 |
| | | | Normal dodecane | | | | 1.65 | | | | | | | | |
| | | | Normal tridecane | | | | | 1.65 | | | | | | | |
| | | | Normal tetradecane | | | | | | 1.65 | | 1.65 | | | | |
| | | Component (B) | Nonionic surfactant B | 1.65 | 1.65 | 1.65 | 1.65 | 1.65 | 1.65 | 1.65 | 1.65 | 1.65 | | | |
| | | | Nonionic surfactant C | 0.5 | 0.5 | 0.5 | 0.5 | 0.5 | 0.5 | 0.5 | 0.5 | 0.5 | 3.8 | 3.8 | |
| Step where the composition was used | | | | (b) | (d) | (b) | (b) | (b) | (b) | (a) | (a) | (c) | (b) | (a) | (b) |
| Deodorization | | | | 2.5 | 2.5 | 2.5 | 1.5 | 1 | 2 | 3 | 3 | 3 | 3.5 | 4 | 3 |
| Base smell | | | | 1 | 1 | 2 | 1 | 1 | 1 | 1 | 1 | 2 | 3.5 | 3 | 4 |

Example 3

Using the formulations shown in Table 3, Composition 1 for the cleaning step (1) and Composition 2 for the cleaning step (2) were prepared. These compositions were used in any one of the following cleaning steps (a) to (e) to test deodorization and base smell by the methods described below. In this test, the content in a glass bottle with a cap was stirred at 80° C. with a magnetic stirrer. The results are shown in Table 3. The components in Table 3 are the same as in Example 1.

(Cleaning Steps)

(a) Hot-water cleaning 1: dipping and stirring at 80° C. for 20 minutes.

(b) Alkali cleaning: dipping and stirring at 80° C. for 20 minutes in 2% NaOH aqueous solution.

(c) Hot-water cleaning 2: dipping and stirring at 80° C. for 20 minutes.

(d) Acid cleaning: dipping and stirring for 20 minutes in 0.6% $HNO_3$ aqueous solution.

(e) Hot-water cleaning 3: dipping and stirring at 80° C. for 20 minutes.

(1) Test Sample

A sample prepared in the same manner as in Example 1 was used as the test sample.

(2) Test Method

Composition 1 (3.8 g in terms of the active ingredients) in Table 3 was introduced into a 100-cc glass bottle with a cap, followed by adding water to the composition when used in step (a) or a predetermined amount of NaOH and water to the composition when used in step (b), to adjust the total weight to 100 g. The solution in the glass bottle with a cap was stirred at 80° C. with a magnetic stirrer.

When Composition 1 was used in step (a), one test sample was introduced into the glass bottle with a cap containing the prepared dilution containing Composition 1 and subjected to the subsequent steps. Alternatively, when Composition 1 was used in step (b), one test sample after the hot-water cleaning step (a) was introduced into the glass bottle with a cap containing the prepared dilution containing Composition 1 and NaOH and subjected to the subsequent steps.

Then, Composition 2 (3.0 g in terms of the active ingredients) in Table 3 was introduced into a 100-cc glass bottle with a cap, followed by adding a predetermined amount of NaOH and water to the composition when used in step (b), or water to the composition when used in step (c), or a predetermined amount of $HNO_3$ and water to the composition when used in step (d), to adjust the total weight to 100 g. The solution in the glass bottle with a cap was stirred at 80° C. with a magnetic stirrer.

When Composition 2 was used in step (b), one test sample after the step (a) was introduced into the glass bottle with a cap containing the prepared dilution containing Composition 2 and NaOH and subjected to the subsequent steps. When Composition 2 was used in step (c), one test sample after the steps (a) and (b) was introduced into the glass bottle with a cap containing the prepared dilution containing Composition 2 and subjected to the subsequent steps. When Composition 2 was used in step (d), one test sample after the steps (a) to (c) was introduced into the glass bottle with a cap containing the prepared dilution containing Composition 2 and $HNO_3$ and subjected to the subsequent step.

After a series of the cleaning steps, each test piece was dried and transferred into a 50-cc glass bottle with a cap, stored at room temperature for 12 hours and used as an evaluation sample.

(3) Evaluation Method

The same evaluation method and criteria as in Example 1 were used.

TABLE 3

| | | | | Invention product | | | | | | | | | | Comparative product | | | | |
|---|---|---|---|---|---|---|---|---|---|---|---|---|---|---|---|---|---|---|
| | | | | 3-1 | 3-2 | 3-3 | 3-4 | 3-5 | 3-6 | 3-7 | 3-8 | 3-9 | 3-10 | 3-1 | 3-2 | 3-3 | 3-4 | 3-5 |
| Composition (g) | Composition 1 | Component (A) | Normal decane | | | | | | 1.65 | | | | | | | | | |
| | | | Normal undecane | 1.65 | 1.65 | 1.65 | 1.65 | 1.65 | | | | | 1.65 | | | | | |
| | | | Normal dodecane | | | | | | | 1.65 | | | | | | | | |
| | | | Normal tridecane | | | | | | | | 1.65 | | | | | | | |
| | | | Normal tetradecane | | | | | | | | | 1.65 | | | | 3.8 | | 3.8 |

TABLE 3-continued

| | | | Invention product | | | | | | | | | | Comparative product | | | | |
|---|---|---|---|---|---|---|---|---|---|---|---|---|---|---|---|---|---|
| | | | 3-1 | 3-2 | 3-3 | 3-4 | 3-5 | 3-6 | 3-7 | 3-8 | 3-9 | 3-10 | 3-1 | 3-2 | 3-3 | 3-4 | 3-5 |
| | Component (B) | Nonionic surfactant A | | | | | | | | | | 2.15 | | 3.8 | | 3.8 | |
| | | Nonionic surfactant B | 1.65 | 1.65 | 1.65 | 1.65 | 1.65 | 1.65 | 1.65 | 1.65 | 1.65 | | 2.8 | | | | |
| | | Nonionic surfactant C | 0.5 | 0.5 | 0.5 | 0.5 | 0.5 | 0.5 | 0.5 | 0.5 | 0.5 | | 1 | | | | |
| Composition 2 | Component (B) | Nonionic surfactant A | | | | | | | | | | | | 3 | 3 | 3 | 3 |
| | | Nonionic surfactant B | 0.3 | 0.3 | 0.3 | 0.3 | 0.3 | 0.3 | 0.3 | 0.3 | 0.3 | 0.3 | 0.3 | | | | |
| | | Nonionic surfactant C | 2.7 | 2.7 | 2.7 | 2.7 | 2.7 | 2.7 | 2.7 | 2.7 | 2.7 | 2.7 | 2.7 | | | | |
| Step where the composition was used | | Composition 1 | (a) | (a) | (a) | (b) | (b) | (b) | (b) | (b) | (b) | (b) | (b) | (b) | (b) | (a) | (a) |
| | | Composition 2 | (b) | (c) | (d) | (c) | (d) | (d) | (d) | (d) | (d) | (d) | (d) | (d) | (d) | (c) | (c) |
| Deodorization | | | 2 | 2 | 2 | 2 | 2 | 2 | 1 | 0.5 | 1.5 | 2.5 | 3.5 | 3.5 | 2.5 | 4 | 3 |
| Base smell | | | 1 | 1 | 1 | 1 | 2 | 2 | 1 | 1 | 1 | 2.5 | 2 | 3 | 2.5 | 3.5 | 3 |

Example 4

Using the formulations shown in Table 4, Compositions 1 for the cleaning step (1) were prepared. Each of the compositions was used in any one of the following cleaning steps (a) to (d) to test deodorization and base smell by the methods described below. In this test, the content in a beaker was stirred at 80° C. with a magnetic stirrer. The results are shown in Table 4. The components in Table 4 are the same as in Example 1 except for n-dodecyl benzene.

(Cleaning Steps)

(a) Hot-water cleaning 1: dipping and stirring at 80° C. for 20 minutes.

(b) Alkali cleaning: dipping and stirring at 80° C. for 20 minutes in 2% NaOH aqueous solution.

(c) Hot-water cleaning 2: dipping and stirring at 80° C. for 20 minutes.

(d) Acid cleaning: dipping and stirring for 20 minutes in 0.6% $HNO_3$ aqueous solution.

(e) Hot-water cleaning 3: dipping and stirring at 80° C. for 20 minutes.

(1) Test Sample

1S EPDM packing (Osaka Sanitary Metal Industries Cooperative Union) was dipped in a commercial drink ("Momo No Tennensui" manufactured by JT) at 70° C. for 2 hours and then used as the test sample.

(2) Test Method

Composition 1 (20 g in terms of the active ingredients) in Table 4 was subjected to the cleaning steps in the same manner as in Example 2 except that a 1-L beaker was used in place of the 100-cc glass bottle with a cap, and the total weight of the solution was changed from 100 g to 1000 g. The evaluation sample was prepared by the following method.

The test packing after a series of the cleaning steps was placed for 30 seconds in a 1-L beaker containing 1000 g deionized water at 80° C. and then raised, and this water was used as the evaluation sample.

(3) Evaluation Method

The same evaluation method and criteria as in Example 1 were used except that the number of examiners was changed from 2 to 6.

TABLE 4

| | | | | Invention product | | | | | | | | Comparative product | | |
|---|---|---|---|---|---|---|---|---|---|---|---|---|---|---|
| | | | | 4-1 | 4-2 | 4-3 | 4-4 | 4-5 | 4-6 | 4-7 | 4-8 | 4-1 | 4-2 | 4-3 |
| Composition (g) | Composition 1 | Component (A) | Normal decane | | | 8.7 | | | | | | | | |
| | | | Normal undecane | 8.7 | 8.7 | | | | | | 8.7 | | | 20 |
| | | | Normal dodecane | | | | 8.7 | | | | | | | |
| | | | Normal tridecane | | | | | 8.7 | | | | | | |
| | | | Normal tetradecane | | | | | | 8.7 | | | | | |
| | | | n-dodecyl benzene *12 | | | | | | | 8.7 | | | | |
| | | Component (B) | Nonionic surfactant A | | | | | | | | | | | |
| | | | Nonionic surfactant B | 8.7 | 8.7 | 8.7 | 8.7 | 8.7 | 8.7 | 8.7 | 8.7 | | | |
| | | | Nonionic surfactant C | 2.6 | 2.6 | 2.6 | 2.6 | 2.6 | 2.6 | 2.6 | 2.6 | 20 | 20 | |
| Steo where the composition was used | | | | (b) | (d) | (b) | (b) | (b) | (b) | (b) | (a) | (b) | (a) | (b) |
| Deodorization | | | | 1.5 | 1.5 | 1.5 | 1.5 | 2 | 2 | 2 | 2 | 4 | 4 | 2.5 |
| Base smell | | | | 1 | 1 | 1 | 1 | 1 | 1 | 1 | 1 | 2 | 1.5 | 1 |

n-Dodecyl benzene *12 Reagent (purity 99%) with an SP value of 8.3 at 25° C. and a melting point of 20° C. or less.

Example 5

Using the formulations shown in Table 5, Composition 1 for the cleaning step (1) and Composition 2 for the cleaning step (2) were prepared. These compositions were used in any one of the following cleaning steps (a) to (e) to test deodorization and base smell by the methods described below. In this test, the content in a beaker was stirred at 80° C. with a magnetic stirrer. The results are shown in Table 5. The components in Table 5 are the same as in Example 4.

TABLE 5

| | | | | Invention product | | | | | | | Comparative product | | | | |
|---|---|---|---|---|---|---|---|---|---|---|---|---|---|---|---|
| | | | | 5-1 | 5-2 | 5-3 | 5-4 | 5-5 | 5-6 | 5-7 | 5-1 | 5-2 | 5-3 | 5-4 | 5-5 |
| Composition (g) | Composition 1 | Component (A) | Normal decane | | 8.7 | | | | | | | | | | |
| | | | Normal undecane | 8.7 | | | | | | 8.7 | | | | | |
| | | | Normal dodecane | | | 8.7 | | | | | | | | | |
| | | | Normal tridecane | | | | 8.7 | | | | | | | | |
| | | | Normal tetradecane | | | | | 8.7 | | | | | 20 | | 20 |
| | | | n-Dodecyl benzene | | | | | | 8.7 | | | | | | |
| | | Component (B) | Nonionic surfactant A | | | | | | | 11.3 | | 20 | | 20 | |
| | | | Nonionic surfactant B | 8.7 | 8.7 | 8.7 | 8.7 | 8.7 | 8.7 | | 14.7 | | | | |
| | | | Nonionic surfactant C | 2.6 | 2.6 | 2.6 | 2.6 | 2.6 | 2.6 | | 5.3 | | | | |
| | Composition 2 | Component (B) | Nonionic surfactant A | | | | | | | | | 20 | 20 | 20 | 20 |
| | | | Nonionic surfactant B | 2 | 2 | 2 | 2 | 2 | 2 | 2 | 2 | | | | |
| | | | Nonionic surfactant C | 18 | 18 | 18 | 18 | 18 | 18 | 18 | 18 | | | | |
| Step where the composition was used | | | Composition 1 | (a) | (b) | (b) | (b) | (b) | (b) | (b) | (b) | (b) | (b) | (a) | (a) |
| | | | Composition 2 | (b) | (d) | (d) | (d) | (d) | (d) | (d) | (d) | (d) | (d) | (c) | (c) |
| Deodorization | | | | 1 | 1 | 1.5 | 2 | 2 | 2 | 1 | 3.5 | 3.5 | 2.5 | 4 | 3 |
| Base smell | | | | 1 | 1 | 1 | 1 | 1 | 1 | 1.5 | 2 | 3 | 2.5 | 3.5 | 3 |

(Cleaning Steps)

(a) Hot-water cleaning 1: dipping and stirring at 80° C. for 20 minutes.

(b) Alkali cleaning: dipping and stirring at 80° C. for 20 minutes in 2% NaOH aqueous solution.

(c) Hot-water cleaning 2: dipping and stirring at 80° C. for 20 minutes.

(d) Acid cleaning: dipping and stirring for 20 minutes in 0.6% $HNO_3$ aqueous solution.

(e) Hot-water cleaning 3: dipping and stirring at 80° C. for 20 minutes.

(1) Test Sample

A sample prepared in the same manner as in Example 4 was used as the test sample.

(2) Test Method

Composition 1 (20 g in terms of the active ingredients) in Table 5 was subjected to the cleaning steps in the same manner as in Example 3 except that a 1-L beaker was used in place of the 100-cc glass bottle with a cap, and the total weight of the solution was changed from 100 g to 1000 g.

Then, Composition 2 (20 g in terms of the active ingredients) in Table 5 was subjected to the cleaning steps in the same manner as in Example 3 except that a 1-L beaker was used in place of the 100-cc glass bottle with a cap, and the total weight of the solution was changed from 100 g to 1000 g. The evaluation sample was prepared by the following method.

The test packing after a series of the cleaning steps was placed for 30 seconds in a 1-L beaker containing 1000 g deionized water at 80° C. and then raised, and this water was used as the evaluation sample.

(3) Evaluation Method

The same evaluation method and criteria as in Example 1 were used except that the number of examiners was changed from 2 to 6.

Example 6

Using the formulations shown in Table 6, Compositions 1 for the cleaning step (1) were prepared. Each of the compositions was used in any one of the following cleaning steps (a) to (d) to test deodorization and base smell by the methods described below. In this test, the content in a beaker was stirred at 80° C. with a magnetic stirrer. The results are shown in Table 6. The components in Table 6 are the same as in Example 1 except for component (A) and nonionic surfactant D.

(Cleaning Steps)

(a) Hot-water cleaning 1: dipping and stirring at 80° C. for 20 minutes.

(b) Alkali cleaning: dipping and stirring at 80° C. for 20 minutes in 2% NaOH aqueous solution.

(c) Hot-water cleaning 2: dipping and stirring at 80° C. for 20 minutes.

(d) Acid cleaning: dipping and stirring for 20 minutes in 0.6% $HNO_3$ aqueous solution.

(e) Hot-water cleaning 3: dipping and stirring at 80° C. for 20 minutes.

(1) Test Sample

A test sample was prepared in the same manner as in Example 1 except that a commercial drink ("Momo No Tennensui" manufactured by JT) was used as fluid giving a flavor in place of the peach flavor.

(2) Test Method

Composition 1 (2.0 g in terms of the active ingredients) in Table 6 was subjected to the cleaning steps in the same manner as in Example 2. The evaluation sample was prepared by the following method.

The test piece after a series of the cleaning steps was placed for 30 seconds in a 100-cc glass bottle with a cap containing 50 g deionized water at 80° C. and then raised, and this water was used as the evaluation sample.

(3) Evaluation Method

The same evaluation method and criteria as in Example 1 were used except that the number of examiners was changed from 2 to 6.

TABLE 6

| | | | | Invention product | | | | | | | | | | | Comparative product |
|---|---|---|---|---|---|---|---|---|---|---|---|---|---|---|---|
| | | | | 6-1 | 6-2 | 6-3 | 6-4 | 6-5 | 6-6 | 6-7 | 6-8 | 6-9 | 6-10 | 6-11 | 6-1 |
| Composition 1 | Composition (g) | Component (A) | Octyl stearate *13 | 0.87 | | | | | | | | | | | |
| | | | Octyldodecyl myristate *14 | | 0.87 | | | 0.87 | 0.87 | 0.87 | 0.87 | | | | |
| | | | Rapeseed oil *15 | | | 0.87 | | | | | | 0.87 | 0.87 | 0.87 | |
| | | | Soybean oil *16 | | | | 0.87 | | | | | | | | |
| | | Component (B) | Nonionic surfactant B | 0.87 | 0.87 | 0.87 | 0.87 | | | | | 0.87 | 0.87 | 0.87 | |
| | | | Nonionic surfactant C | 0.26 | 0.26 | 0.26 | 0.26 | | | | | 0.26 | 0.26 | 0.26 | |
| | | | Nonionic surfactant D *17 | | | | | 1.13 | | | | | | | |
| | | | Anionic surfactant A | | | | | | 1.13 | | | | | | |
| | | | Cationic surfactant A | | | | | | | 1.13 | | | | | |
| | | | Amphoteric surfactant A | | | | | | | | 1.13 | | | | |
| Step where the composition was used | | | | (a) | (a) | (a) | (a) | (a) | (a) | (a) | (a) | (b) | (c) | (d) | — |
| Deodorization | | | | 3 | 3 | 2 | 3 | 3 | 3 | 3 | 3 | 2 | 2 | 2 | 5 |
| Base smell | | | | 1 | 1 | 1 | 1 | 1.5 | 1 | 1 | 1 | 1 | 1 | 1 | 1 |

Octyl stearate *13 Exceparl EH-S manufactured by Kao Corporation; solubility (relative to water, 25° C.), 1 wt % or less; number of ester groups, 1; SP value at 25° C., 8.1; melting point, 20° C. or less.
Octyldodecyl myristate *14 Exceparl OD-M manufactured by Kao Corporation; solubility (relative to water, 25° C.), 1 wt % or less; number of ester groups, 1; SP value at 25° C., 8.0; melting point, 20° C. or less.
Rapeseed oil *15 Reagent; solubility (relative to water, 25° C.), 1 wt % or less; number of ester groups in the triglyceride as a main component, 3; SP value at 25° C., 8.3; melting point, 20° C. or less.
Soybean oil *16 Reagent; solubility (relative to water, 25° C.), 1 wt % or less; number of ester groups in the triglyceride as a main component, 3; SP value at 25° C., 8.5; melting point, 20° C. or less.
Nonionic surfactant D *17 Polyoxyethylene alkyl amine [Amiet 308, manufactured by Kao Corporation]

Example 7

Using the formulations shown in Table 7, Composition 1 for the cleaning step (1) and Composition 2 for the cleaning step (2) were prepared. These compositions were used in any one of the following cleaning steps (a) to (e) to test deodorization and base smell by the methods described below. In this test, the content in a beaker was stirred at 80° C. with a magnetic stirrer. The results are shown in Table 7. The components in Table 7 are the same as in Example 6.

(Cleaning Steps)

(a) Hot-water cleaning 1: dipping and stirring at 80° C. for 20 minutes.
(b) Alkali cleaning: dipping and stirring at 80° C. for 20 minutes in 2% NaOH aqueous solution.
(c) Hot-water cleaning 2: dipping and stirring at 80° C. for 20 minutes.
(d) Acid cleaning: dipping and stirring for 20 minutes in 0.6% $HNO_3$ aqueous solution.
(e) Hot-water cleaning 3: dipping and stirring at 80° C. for 20 minutes.

(1) Test Sample

A sample prepared in the same manner as in Example 6 was used as the test sample.

(2) Test Method

Composition 1 (2.0 g in terms of the active ingredients) in Table 7 was subjected to the cleaning steps in the same manner as in Example 3.

Then, Composition 2 (3.0 g in terms of the active ingredients) in Table 7 was subjected to the cleaning steps in the same manner as in Example 3. The evaluation sample was prepared by the following method.

The test piece after a series of the cleaning steps was placed for 30 seconds in a 100-cc glass bottle with a cap containing 50 g deionized water at 80° C. and then raised. This water was used as the evaluation sample.

(3) Evaluation Method

The same evaluation method and criteria as in Example 1 were used except that the number of examiners was changed from 2 to 6.

TABLE 7

| | | | | Invention method | | | | Comparative method |
|---|---|---|---|---|---|---|---|---|
| | | | | 7-1 | 7-2 | 7-3 | 7-4 | 7-1 |
| Composition (g) | Composition 1 | Component (A) | Octyl syearate | 0.8 | | | | |
| | | | Octyldodecyl myristate | | | | 0.8 | |
| | | | Rapeseed oil | | 0.8 | | | |
| | | | Soybean oil | | | 0.8 | | |
| | | Component (B) | Nonionic surfactant B | 0.9 | 0.9 | 0.9 | | |
| | | | Nonionic surfactant C | 0.3 | 0.3 | 0.3 | | |
| | | | Nonionic surfactant D | | | | 1.2 | |
| | Composition 2 | Component (B) | Nonionic surfactant B | 2 | 2 | 2 | 2 | |
| | | | Nonionic surfactant C | 1 | 1 | 1 | 1 | |

TABLE 7-continued

| | | Invention method | | | | Comparative method |
|---|---|---|---|---|---|---|
| | | 7-1 | 7-2 | 7-3 | 7-4 | 7-1 |
| Step where the composition was used | Composition 1 | (b) | (b) | (b) | (b) | — |
| | Composition 2 | (d) | (d) | (d) | (d) | — |
| Deodorization | | 2 | 2 | 2 | 2 | 5 |
| Base smell | | 1 | 1 | 1 | 1.5 | 1 |

Example 8

Using the formulations shown in Table 8, Compositions 1 for the cleaning step (1) were prepared. Each of the compositions was used in any one of the following cleaning steps (a) to (d) to test deodorization and base smell by the methods described below. In this test, the content in a beaker was stirred at 80° C. with a magnetic stirrer. The results are shown in Table 8. Component (B) in Table 8 is the same as in Example 6.

The test piece after a series of the cleaning steps was placed for 30 seconds in a 100-cc glass bottle with a cap containing 50 g deionized water at 80° C. and then raised. This water was used as the evaluation sample.

(3) Evaluation Method

The same evaluation method and criteria as in Example 1 were used except that the number of examiners was changed from 2 to 6.

TABLE 8

| | | | | Invention product | | | | | | | | | | Comparative product | |
|---|---|---|---|---|---|---|---|---|---|---|---|---|---|---|---|
| | | | | 8-1 | 8-2 | 8-3 | 8-4 | 8-5 | 8-6 | 8-7 | 8-8 | 8-9 | 8-10 | 8-1 | 8-2 |
| Composition (g) | Composition 1 | Component (A) | n-Decanol *18 | 0.87 | | | | | | | | | | | |
| | | | 2-Octyl dodecanol *19 | | 0.87 | | 0.87 | 0.87 | 0.87 | 0.87 | 0.87 | 0.87 | 0.87 | | |
| | | | Oleyl alcohol *20 | | | 0.87 | | | | | | | | | |
| | | Component (B) | Nonionic surfactant B | 0.87 | 0.87 | 0.87 | | | | | 0.87 | 0.87 | 0.87 | | 0.87 |
| | | | Nonionic surfactant C | 0.26 | 0.26 | 0.26 | | | | | 0.26 | 0.26 | 0.26 | | 0.26 |
| | | | Nonionic surfactant D | | | | 1.13 | | | | | | | | |
| | | | Anionic surfactant A | | | | | 1.13 | | | | | | | |
| | | | Cationic surfactant A | | | | | | 1.13 | | | | | | |
| | | | Amphoteric surfactant A | | | | | | | 1.13 | | | | | |
| | | Ethyl alcohol | | | | | | | | | | | | | 0.87 |
| Step where the composition was used | | | | (a) | (a) | (a) | (a) | (a) | (a) | (a) | (b) | (c) | (d) | — | (a) |
| Deodorization | | | | 3 | 2 | 3 | 2 | 2 | 2 | 2 | 2 | 2 | 2 | 5 | 4.5 |
| Base smell | | | | 1.5 | 1 | 1.5 | 1.5 | 1 | 1 | 1 | 1 | 1 | 1 | 1 | 1 |

n-Decanol *18 Kalcohl 1098 manufactured by Kao Corporation; number of carbon atoms, 10; solubility (relative to water, 25° C.), 1 wt % or less; number of hydroxyl groups, 1; SP value at 25° C., 8.9; melting point, 20° C. or less.
2-Octyl dodecanol *19 Kalcohl 200GD manufactured by Kao Corporation; number of carbon atoms, 20; solubility (relative to water, 25° C.), 1 wt % or less; number of hydroxyl groups, 1; SP value at 25° C., 8.3; melting point, 20° C. or less.
Oleyl alcohol *20 Reagent; number of carbon atoms, 18; solubility (relative to water, 25° C.), 1 wt % or less; number of hydroxyl groups, 1; SP value at 25° C., 8.6; melting point, 20° C. or less.

(Cleaning Steps)

(a) Hot-water cleaning 1: dipping and stirring at 80° C. for 20 minutes.
(b) Alkali cleaning: dipping and stirring at 80° C. for 20 minutes in 2% NaOH aqueous solution.
(c) Hot-water cleaning 2: dipping and stirring at 80° C. for 20 minutes.
(d) Acid cleaning: dipping and stirring for 20 minutes in 0.6% $HNO_3$ aqueous solution.
(e) Hot-water cleaning 3: dipping and stirring at 80° C. for 20 minutes.

(1) Test Sample

A sample prepared in the same manner as in Example 6 was used as the test sample.

(2) Test Method

Composition 1 (2.0 g in terms of the active ingredients) in Table 8 was subjected to the cleaning steps in the same manner as in Example 2. The evaluation sample was prepared by the following method.

Example 9

Using the formulations shown in Table 9, Composition 1 for the cleaning step (1) and Composition 2 for the cleaning step (2) were prepared. These compositions were used in any one of the following cleaning steps (a) to (e) to test deodorization and base smell by the methods described below. In this test, the content in a beaker was stirred at 80° C. with a magnetic stirrer. The results are shown in Table 9. The components in Table 9 are the same as in Example 8.

(Cleaning Steps)

(a) Hot-water cleaning 1: dipping and stirring at 80° C. for 20 minutes.
(b) Alkali cleaning: dipping and stirring at 80° C. for 20 minutes in 2% NaOH aqueous solution.
(c) Hot-water cleaning 2: dipping and stirring at 80° C. for 20 minutes.
(d) Acid cleaning: dipping and stirring for 20 minutes in 0.6% $HNO_3$ aqueous solution.

(e) Hot-water cleaning 3: dipping and stirring at 80° C. for 20 minutes.

(1) Test Sample

A sample prepared in the same manner as in Example 6 was used as the test sample.

(2) Test Method

Composition 1 (2.0 g in terms of the active ingredients) in Table 9 was subjected to the cleaning steps in the same manner as in Example 3.

Then, Composition 2 (3.0 g in terms of the active ingredients) in Table 9 was subjected to the cleaning steps in the same manner as in Example 3. The evaluation sample was prepared by the following method.

The test piece after a series of the cleaning steps was placed for 30 seconds in a 100-cc glass bottle with a cap containing 50 g deionized water at 80° C. and then raised. This water was used as the evaluation sample.

(3) Evaluation Method

The same evaluation method and criteria as in Example 1 were used except that the number of examiners was changed from 2 to 6.

TABLE 9

| | | | | Invention method | | | Comparative method | |
|---|---|---|---|---|---|---|---|---|
| | | | | 9-1 | 9-2 | 9-3 | 9-1 | 9-2 |
| Composition (g) | Composition 1 | Component (A) | n-Decanol | | | 0.8 | | |
| | | | 2-Octyl dodecanol | 0.8 | | | | |
| | | | Oleyl alcohol | | 0.8 | | | |
| | | Component (B) | Nonionic surfactant B | 0.9 | 0.9 | | | 0.9 |
| | | | Nonionic surfactant C | 0.3 | 0.3 | | | 0.3 |
| | | | Nonionic surfactant D | | | 1.2 | | |
| | | Ethyl alcohol | | | | | | 0.8 |
| | Composition 2 | Component (B) | Nonionic surfactant B | 2 | 2 | 2 | | 2 |
| | | | Nonionic surfactant C | 1 | 1 | 1 | | 1 |
| Step where the composition was used | | | Composition 1 | (b) | (b) | (b) | — | (b) |
| | | | Composition 2 | (d) | (d) | (d) | — | (d) |
| Deodorization | | | | 2 | 2 | 2 | 5 | 4 |
| Base smell | | | | 1.5 | 1.5 | 1.5 | 1 | 1 |

The invention claimed is:

1. A clean-in-place (CIP) method which comprises the steps of:

(1) contacting a material to be cleaned with a cleaning medium (I) comprising:

(A) from 0.01 to 20 wt % of a C10 to C14 aliphatic hydrocarbon solvent and having an SP value of 6 to 9 at 25° C.; and (B) from 0.01 to 20 wt % of a nonionic surfactant; and thereafter, (2) contacting the material to be cleaned with a cleaning medium (II) comprising:

(A) less than 0.5 wt % of a C10 to C14 aliphatic hydrocarbon solvent having an SP value of 6 to 9 at 25° C.; and (B) a nonionic surfactant.

2. The CIP method of claim 1 wherein the cleaning medium (I) is added to an alkali detergent.

3. The CIP method of claim 1 wherein the cleaning medium (I) is added to an acid detergent.

4. The CIP method of claim 1 wherein the cleaning medium (I) is added to water.

5. The CIP method of claim 1 wherein the material to be cleaned is contacted with the cleaning medium (I) at a temperature of 60° C. or more.

6. The CIP method of claim 1 wherein the cleaning medium (I) is added to an alkali detergent, and the cleaning medium (II) is added to an acid detergent.

7. The CIP method of claim 1 wherein the material to be cleaned is contacted with the cleaning medium (I) at a temperature of 60° C. or more, and the material to be cleaned is contacted with the cleaning medium (II) at a temperature of 60° C. or more.

8. The CIP method of claim 1 wherein the nonionic surfactant in the cleaning medium (II) is present in an amount of from 0.01 to 30 wt %.

9. The CIP cleaning method according to claim 1, which comprises a step of judging acceptance or rejection by sensory evaluation of a rinse after the cleaning medium (I) or the cleaning mediums (I) and (II) have been used.

10. The CIP cleaning method according to claim 1, wherein the cleaning solution comprising the cleaning medium (I) or (II) is flowed at a flow rate of 0.5 to 5 m/sec.

11. The CIP cleaning method according to claim 1, wherein the nonionic surfactant (B) is at least one selected from the group consisting of alkyl polyglycoside and alkyl glyceryl ether.

12. The CIP method according to claim 1, wherein in cleaning medium (I), the content of the solvent (A) is 0.5 to 5% by weight, and the content of the nonionic surfactant (B) is 0.05 to 10% by weight.

* * * * *